US009624718B2

(12) United States Patent
Geller et al.

(10) Patent No.: US 9,624,718 B2
(45) Date of Patent: Apr. 18, 2017

(54) DYNAMIC DESK ACCESSORY DELIVERING ON-DEMAND PRIVACY ON AN OPEN WORK TABLE

(71) Applicant: ALLSTEEL INC., Muscatine, IA (US)

(72) Inventors: Marilyn Geller, Chatham, NY (US); Tracy J. Sass, Davenport, IA (US); Andrew R. Trahan, Muscatine, IA (US)

(73) Assignee: ALLSTEEL INC., Muscatine, IA (US)

( * ) Notice: Subject to any disclaimer, the term of this patent is extended or adjusted under 35 U.S.C. 154(b) by 0 days.

(21) Appl. No.: 14/812,903

(22) Filed: Jul. 29, 2015

(65) Prior Publication Data

US 2016/0032644 A1 Feb. 4, 2016

Related U.S. Application Data

(60) Provisional application No. 62/031,134, filed on Jul. 30, 2014.

(51) Int. Cl.
*E06B 9/24* (2006.01)
*A47B 13/00* (2006.01)

(52) U.S. Cl.
CPC ..... *E06B 9/24* (2013.01); *A47B 13/00* (2013.01); *A47B 2200/0084* (2013.01)

(58) Field of Classification Search
CPC . E06B 9/24; E06B 9/06; E06B 9/0607; E06B 2009/2488; E04H 1/12; E04F 10/10
USPC ..... 160/134, 80.7, 62, 132; 52/36.2
See application file for complete search history.

(56) References Cited

U.S. PATENT DOCUMENTS 2,080,786 A * 5/1937 Robles ..... B65D 43/00 160/132
2,627,913 A * 2/1953 Hill ..... B60J 3/005 160/132
3,229,846 A * 1/1966 Katz ..... B65F 1/16 160/132
4,784,468 A 11/1988 Tierney
5,177,912 A 1/1993 Ball
5,877,896 A 3/1999 Gremban
6,213,191 B1 4/2001 Nitzsche
(Continued)

OTHER PUBLICATIONS

BuzziCockpit, [online], [retrieved on Jul. 30, 2015] Retrieved from BuzziSpace using Internet <URL:http://buzzi.space/buzzicockpit/>.
(Continued)

*Primary Examiner* — Blair M Johnson
(74) *Attorney, Agent, or Firm* — Faegre Baker Daniels LLP

(57) ABSTRACT

A privacy accessory includes a base having a body portion; a retention portion defining a retention edge for releasably securing the base to a work surface; a plurality of frame members secured to the base, each frame member having a first side portion pivotably secured to the base and a second side portion pivotably secured to the base, each of the plurality of frame members telescopically received with an adjacent one of the plurality of frame members in a series that graduate from a smallest one to a largest one, the frame members being sequentially deployable to a first, expanded state by pulling on the largest one and sequentially folded to a second, collapsed state by pushing on the largest one of the plurality of frame members.

21 Claims, 5 Drawing Sheets

(56) References Cited

U.S. PATENT DOCUMENTS

| | | | | |
|---|---|---|---|---|
| 6,769,747 | B2 | 8/2004 | Chan et al. | |
| 2002/0020707 | A1 * | 2/2002 | Hardy | A47F 3/004 220/252 |

OTHER PUBLICATIONS

Seth, Radhika. No Peeping Tom Over My Shoulder [online], [retreieved on Jul. 30, 2015]. Retrieved from the Internet <URL:http://www.yankodesign.com/2010/07/02/no-peeping-tom-over-my-shoulder/>.

* cited by examiner

DYNAMIC DESK ACCESSORY DELIVERING ON-DEMAND PRIVACY ON AN OPEN WORK TABLE

CROSS-REFERENCE TO RELATED APPLICATION

This application claims priority to Provisional Application No. 62/031,134, filed Jul. 30, 2014, which is incorporated herein by reference in its entirety.

TECHNICAL FIELD

The present disclosure relates to coverings and shields for enclosing a work space. More particularly, the present disclosure relates to a covering for enclosing a desk.

SUMMARY

A privacy accessory comprising a base configured to rest on a work surface, the base defining a first side, a second side opposite the first side, a top, and a bottom, the base including a body portion that defines a bottom surface for resting on a work surface; a retention portion that projects from the body portion, the retention portion defining a retention edge for releasably securing the base to a work surface; a plurality of frame members secured to the base, each frame member having a first side portion pivotably secured to the first side of the base and a second side portion pivotably secured to the second side of the base, each of the plurality of frame members telescopically received with an adjacent one of the plurality of frame members in a series of frame members that graduate from a smallest of the plurality of frame members to a largest of the plurality of frame members, the plurality of frame members being sequentially deployable to a first, expanded state by pulling on the largest of the plurality of frame members and sequentially folded to a second, collapsed state by pushing on the largest of the plurality of frame members.

A work surface system comprising a work surface including a substantially planar member defining a front edge; a privacy accessory, including a base resting on the planar member of the work surface, the base defining a first side, a second side opposite the first side, a top, and a bottom, the base including a body portion that is substantially arcuate in shape and defines a bottom surface resting on the planar member of the work surface; a retention portion that projects from the body portion, the retention portion engaged with the front edge of the work surface to releasably secure the base to the work surface; a plurality of frame members secured to the base, each frame member having an arcuate shape defining a radius of curvature and having a first side portion pivotably secured to the first side of the base and a second side portion pivotably secured to the second side of the base, each of the plurality of frame members telescopically received with an adjacent one of the plurality of frame members in a series of frame members that graduate from a smallest arc one of the plurality of frame members to a largest arc one of the plurality of frame members, the plurality of frame members being sequentially deployable to a first, expanded state by pulling on the largest arc one of the plurality of frame members and sequentially folded to a second, collapsed state by pushing on the largest radius one of the plurality of frame members.

A method of assembling a privacy accessory, the method comprising pivotably securing first side portions of each of a plurality of frame members to a first side of a base that is configured to rest on a work surface, the base including a body portion that is substantially arcuate in shape and defines a bottom surface for resting on a work surface and a retention portion that projects from the body portion, the retention portion defining a retention edge for releasably securing the base to a work surface; pivotably securing a second side portions of each of the plurality of frame members to the base, each frame member having an arcuate shape defining a radius of curvature, each of the plurality of frame members telescopically received with an adjacent one of the plurality of frame members in a series of frame members that graduate from a smallest arc one of the plurality of frame members to a largest arc one of the plurality of frame members, the plurality of frame members being sequentially deployable to a first, expanded state by pulling on the largest arc one of the plurality of frame members and sequentially folded to a second, collapsed state by pushing on the largest radius one of the plurality of frame members.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Figures 1A, 1B, 1C:
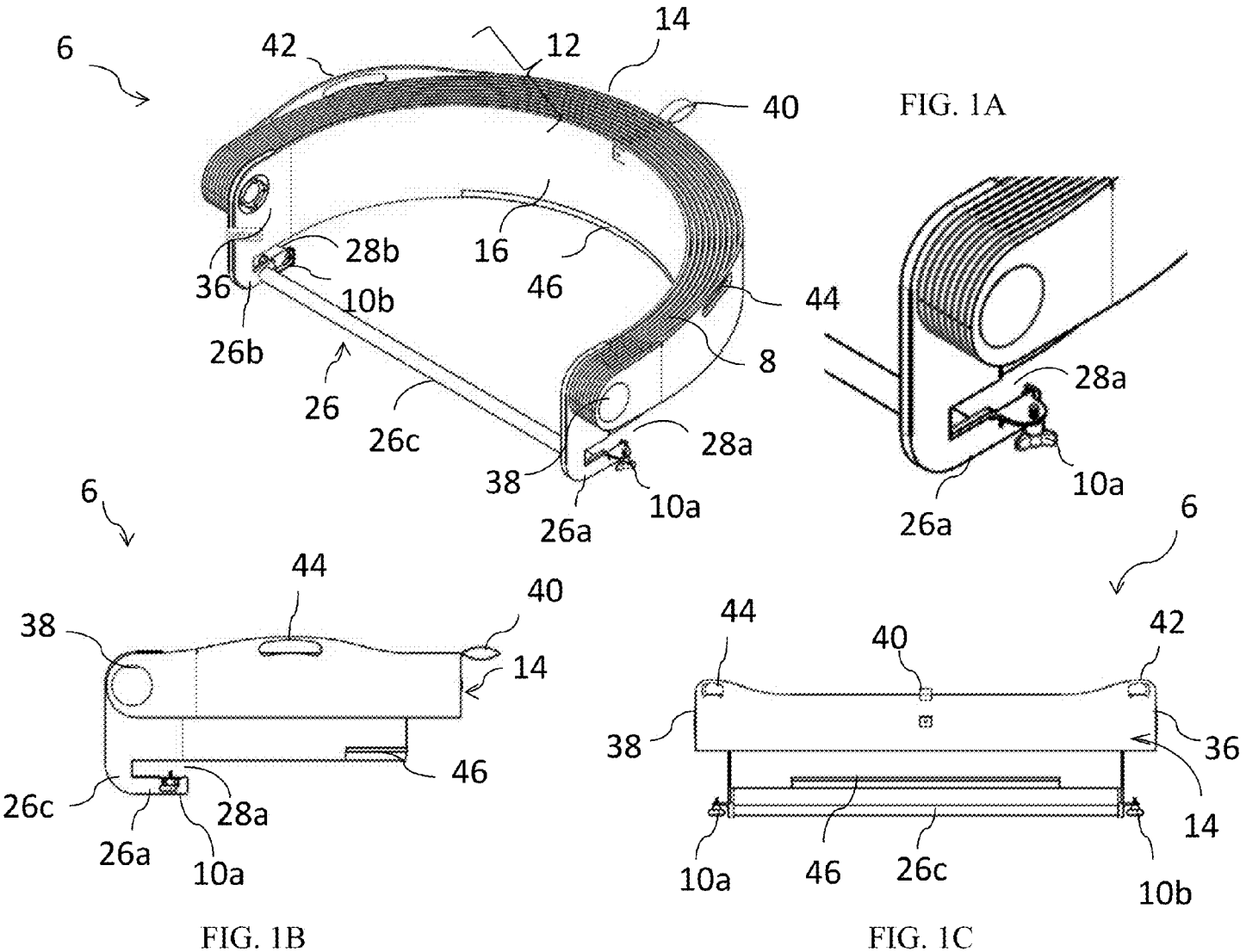
FIG. 1A is a perspective view of a privacy shield in a first position, according to some embodiments.
FIG. 1B is a left side view of a privacy shield in the first position, according to some embodiments.
FIG. 1C is a rear view of a privacy shield in the first position, according to some embodiments.

Various aspects of the disclosure relate to desk accessories, also described herein as privacy shields, for delivering on-demand privacy to a user in an open work space. "On-demand" privacy is indicative that a user is capable of transitioning to a privacy configuration in which the user is at least partially screened (e.g., the upper torso and head of the user is screened from between 90 and 180 degree viewing angles). Regardless, the on-demand privacy shield gives the user the opportunity to control his or her individual work environment by providing visual and/or sound privacy to the user. When the privacy shield is telescoped it allows participation in a collaborative environment. When the privacy shield is extended it provides privacy for the individual user. Using the privacy shield of the instant disclosure, the user does not need to leave his or her work space to have privacy, thereby increasing productivity. The user has the opportunity to control their work environment to be suitable to the task at hand by opening or closing the invention.

As illustrated in FIGS. 1A-1C, 2A-2C, and 3A-3C the privacy shield 6 contains a covering or enclosure 8 that provides a visual barrier that may separate a user from his or her surroundings. The privacy shield 6 may be placed over a work surface, such as a desk, a table, or a part of a table and the removable enclosure 8 or shell enables a user to work, read, or perform other tasks within the enclosure 8. The privacy shield 6 may enable a user to work or perform tasks within the privacy of the enclosure 8 while persons outside the enclosure are not able to see into the enclosure 8. The privacy shield may also enable a user to work or perform tasks within the enclosure 8 without being able to see out of the enclosure 8.

As illustrated in FIGS. 1A-1C, 2A-2C, and 3A-3C, in some embodiments, the privacy shield 6 may include a retention portion 26 attached to the enclosure 8. The retention portion 26 may be used to position the enclosure 8 on a surface such as the surface of a desk or a table. The retention portion 26 may define a retention edge for releasably securing the base to a work surface. In some embodiments, the retention portion 26 may include a clamp 10*a*, 10*b* for releasably securing the enclosure to a work surface. For example, the retention portion 26 optionally includes a first bracket 26*a*, a second bracket 26*b*, and a cross member 26*c* extending between the first and second brackets 26*a*, 26*b*. As shown, the first bracket 26*a* forms a channel 28*a* (also described as a mouth or receiver), including a downward projecting stop, and the second bracket 26*b* forms a channel 28*b* (also described as a mouth or receiver) including a downward projecting stop. Each of the channels 28*a*, 28*b* is adapted to receive the edge of a work surface (not shown), such as a table. Following insertion of the work surface edge into the channels, the clamps 10*a*, 10*b* are tightened to releasably secure the privacy shield 6 to the work surface (not shown). In some embodiments, clamps 10*a* and 10*b* may be formed to permanently affix the privacy shield 6 to a work surface. For example, clamps 10*a*, 10*b* may include a bolt or screw for affixing the privacy shield 6 to a work surface.

As illustrated in FIGS. 1A-1C, 2A-2C, and 3A-3C, the enclosure is generally comprised of a plurality of panels 12, also referred to as slats, bands, shells, or arcuate frame members. The panels 12 collectively make up the enclosure 8 frame. Each panel provides one section of the enclosure 8. Each panel 12 is fashioned as an elongated member having a length greater than the width. In some embodiments as described here, each panel 12 is fashioned in a generally curved shape with an arc radius, however the panels 12 may alternatively be formed with any shape for example a triangular or square shape may be used. The enclosure 8 may be formed by any suitable number of panels 12, for example three, five, or as many as twenty or thirty panels 12 may be used, according to the desired configuration.

As shown in FIGS. 1A-1C, each panel 12 is sized to have an arc radius smaller than the panel 12 adjacent to one side, and larger than the panel 12 adjacent to the other side. The panels 12 are arranged sequentially by size such that the outer most panel 14 has the greatest arc radius and the inner most panel 16 has the smallest arc radius. Thus the panels 12 are sized and arranged to graduate from a panel 12 with a smallest arc radius to a panel 12 with a largest radius.

FIGS. 1A-1C illustrate an example of the enclosure 8 in a first position, with the panels 12 stacked together or telescoped. When in the first position, the panels 12 are stacked and are all resting on the work surface, also described as a collapsed state. When in the first position, the enclosure 8 is in a substantially open configuration, such that a user is able to see his or her surroundings around the work space and others in the work space are able to view the user (e.g., in particular the head and/or upper torso of the user).

Figure 2A:
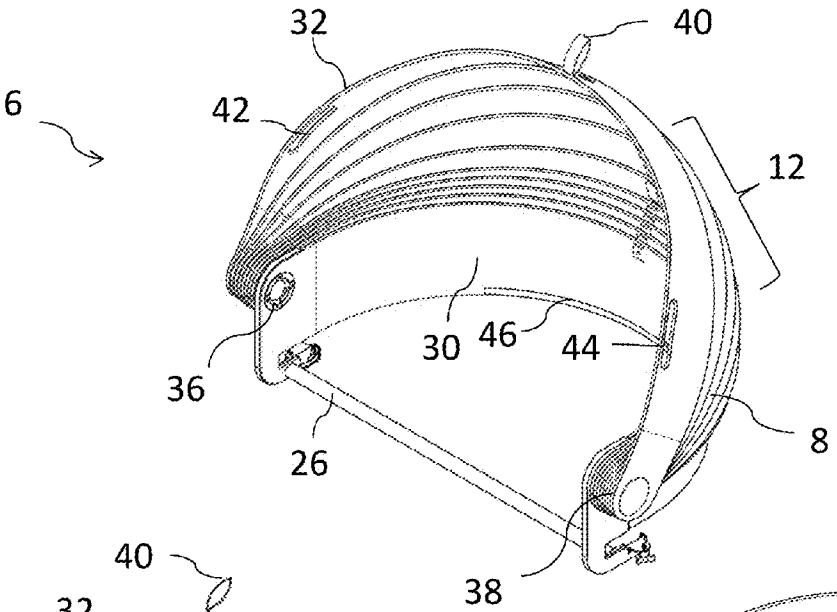
FIG. 2A is a perspective view of a privacy shield in a second position, according to some embodiments.
Figure 2B:
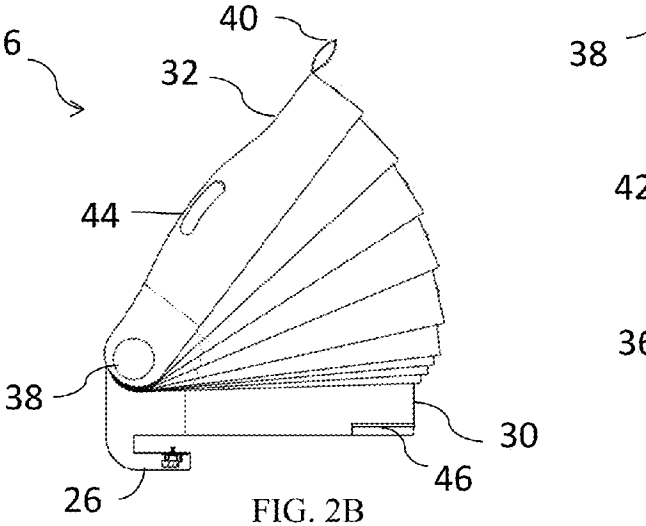
FIG. 2B is a left side view of a privacy shield in the second position, according to some embodiments.
Figure 2C:
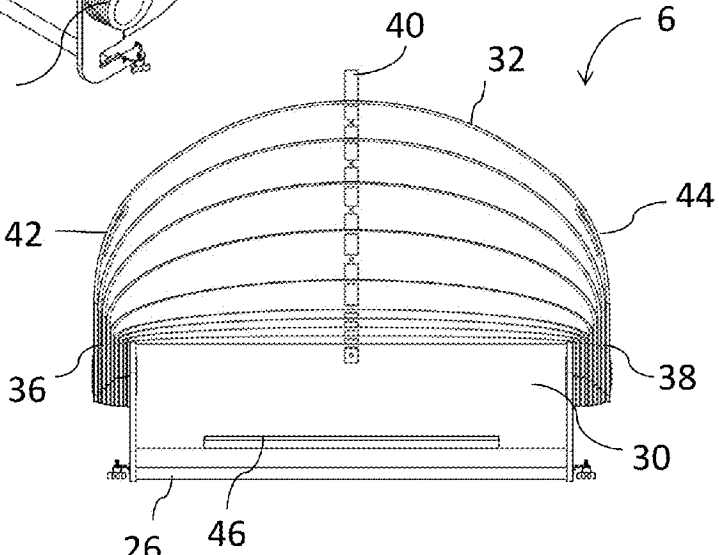
FIG. 2C is a front view of a privacy shield in the second position, according to some embodiments.

FIGS. 2A-2C illustrate the enclosure 8 in a second position. While in the second position, the privacy shield 6 is in a partially expanded position with the panels 12 fanned out from each other. The panels 12 are expanded to form the enclosure 8 by having a first panel 30 forming the first edge of the enclosure 8 remain adjacent to the work space surface, and a last panel 32 forming a second edge that moves up and over the user. In some embodiments, the first panel 30 that remains adjacent to the work space is the inner most panel 14; and the last panel 32 that forms the second edge is the outer most panel 16. The panels 12 are sized such that they can be received within each other in a telescoping fashion, with each panel 12 at least partially overlapping the panel 12 adjacent to it on each side. As the panels 12 are expanded, they collectively begin to form the enclosure 8 around the user's work space.

Figures 3A, 3B, 3C:
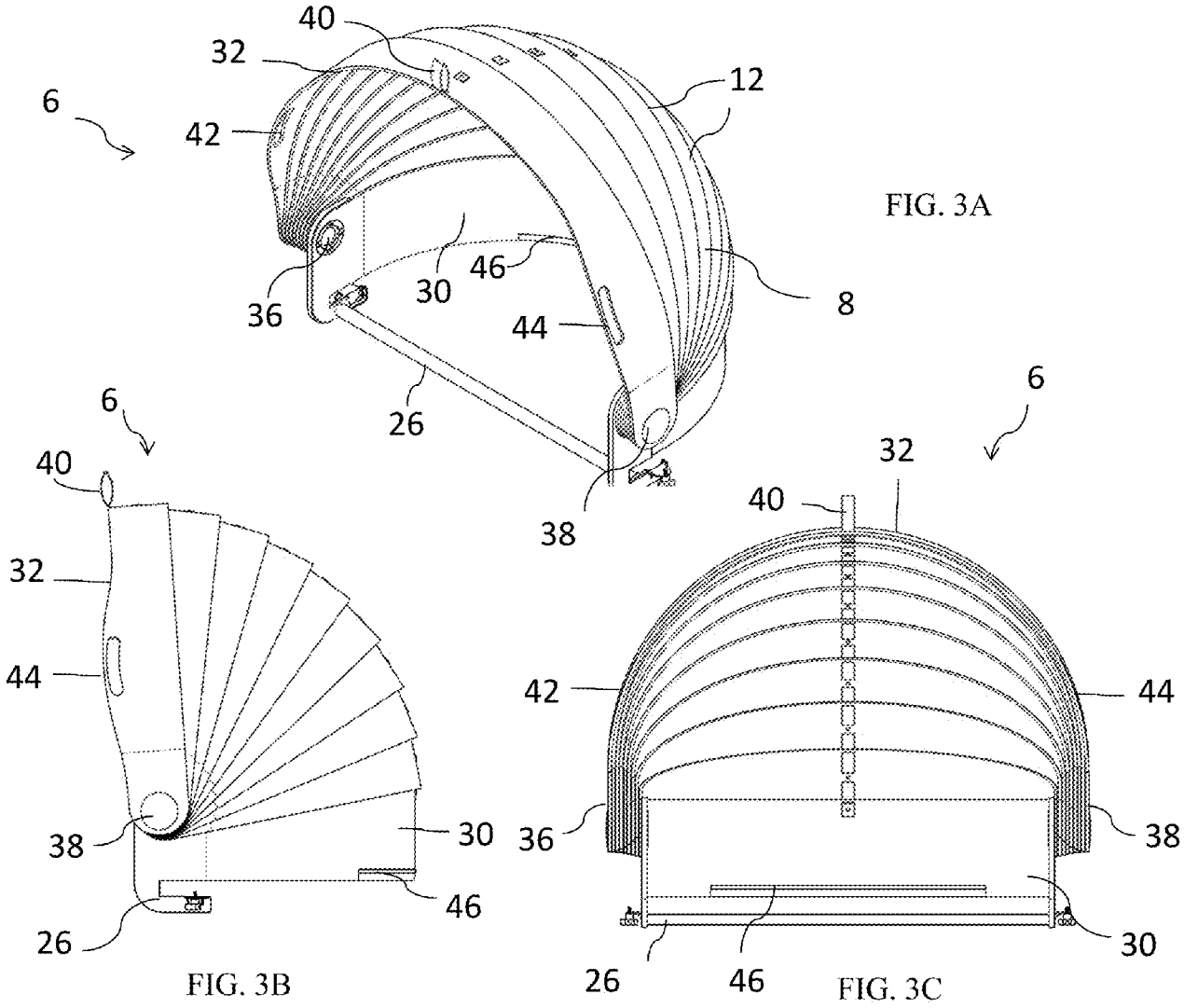
FIG. 3A is a perspective view of a privacy shield in a third position, according to some embodiments.
FIG. 3B is a left side view of a privacy shield in the third position, according to some embodiments.
FIG. 3C is a front view of a privacy shield in the third position, according to some embodiments.

FIGS. 3A-3C illustrate the enclosure 8 in a third position. As shown, in some embodiments, the panels 12 are expanded into the third position to create the enclosure 8 or shield. In some embodiments, the enclosure 8 is created by rotating the outer most panel 16 through 90 degrees. In some embodiments the enclosure may be created by rotating the outer most panel 16 a full 180 degrees. The enclosure 8 or shield may be sized to cover a work space, such as a desk or a portion of a table. In some embodiments, the enclosure 8 may be sized to cover a single person from his or her front, sides and above. In some embodiments, the enclosure 8 may be sized to cover two or more persons from the front, sides, and above.

As illustrated in FIGS. 1A-1C, 2A-2C, and 3A-3C, in some embodiments, the panels 12 expand by rotating about a first pivot point 36 and second pivot point 38, also referred to as a fulcrum, or a hinge. Each panel 12 is individually mounted to the pivot points 36, 38 at the ends of each panel 12. The panels 12 can be configured to rotate about the pivot points 36, 38 independently of the other panels. The panels 12 may be configured so that closing the outer most panel 16 results in all the panels 12 partially closing.

In some embodiments, once in the expanded position, the enclosure 8 can be held in the third position by a clamp or edge stop to secure the panels 12 to each other. In some embodiments, the enclosure 8 may be held in a partially open position, such as the second position, by a clamp or edge stop. In some embodiments, the clamp or edge stop may be incorporated into the pivot points 36, 38 such once the panels are in a user's desired position, the pivot points 36, 38 may be manipulated to prevent the panels 12 from expanding or telescoping further. Alternatively, a clamp or edge stop may be configured to use friction between the panels 12 to prevent the panels 12 from telescoping of expanding further.

In some embodiments, the pivot points 36, 38 of hinges may include a counter weight (not shown). The counter weight may aid in balancing the weight of each panel 12 and may provide assistance when manipulating the panels 12 between a first telescoped position and a second expanded position. With this configuration, the panels 12 can open and close smoothly and evenly. In some embodiments, the 12 panels may be allowed to open or close with the panels 12 evenly spaced from each other as the enclosure 8 opens. Alternatively, the panels 12 may be opened in groups such that some of the panels 12 fully extend one at a time while the remaining panels 12 remain stacked until extended in sequential order.

In some embodiments, the enclosure 8 is moved from the first position shown in FIGS. 1A-1C to the third position shown in FIGS. 3A-3C by pulling a frame pull 40. The frame pull 40 is optionally attached to the last panel 32. The frame pull 40 is used to expand the panels 12 into the third or open position by advancing the last panel 32 up and over the user's head. The panels 12 may be attached to each other in a manner that allows a user to advance the entire enclosure 8 by pulling the frame pull 40. In some embodiments, the frame pull 40 may be attached to a locking mechanism that is released when tension is put on the frame pull 40, and is locked when the frame pull 40 no longer has tension put on it. Using this configuration, the enclosure can be extended to the desired amount, including a third position as shown in FIGS. 3A-3C or a second position as shown in FIGS. 2A-2C, and then locked in place by a user simply by releasing the frame pull 40.

In some embodiments, the frame pull 40 may be released by pushing the frame pull 40 inward towards the last panel 32. Using this configuration allows a user to collapse the enclosure 8 by pushing the frame pull 40 towards the last panel 32 and continuing to push the last panel 31 until the entire enclosure 8 has been returned to the first or closed position shown in FIGS. 1A-1C. Alternatively or additionally, the enclosure 8 may have handles 42, 44, for example a first handle 42 and a second handle 44. The handles 42, 44 can be used to advance the outer most panel 14 or last panel 32 over the user to expand the enclosure 8 into the third position. The handles 42, 44 may also be used to return the enclosure 8 to the first position for example, by pushing the handles 42, 44 to collapse the enclosure 8 into the first position.

In some embodiments, the enclosure 8 may include a pliable cushion 46. A pliable cushion 46 may allow a user to place objects under or through the first panel 30 without causing the enclosure 8 to become unstable. For example, a pliable cushion 46 may be formed that allows a user to place electrical cords or cables underneath the enclosure 8. The pliable cushion 46 can be fashioned from any flexible material that can compress or flex, for example rubber or foam.

In some embodiments, the panels 12 may be constructed from any suitable material such as wood, metal, leather, cardboard, glass, plastic, fabric, felt, or other textile material, or polymeric material. Alternatively, the panels 12 may be made from more than one material. For example, the panels 12 may be made in layers, with the outer facing layer different than the inner facing layer. The panels 12 may be formed by first shaping the panels 12 into individual elongated members and then assembling them one at a time onto the pivot points 36, 38.

Figure 4:
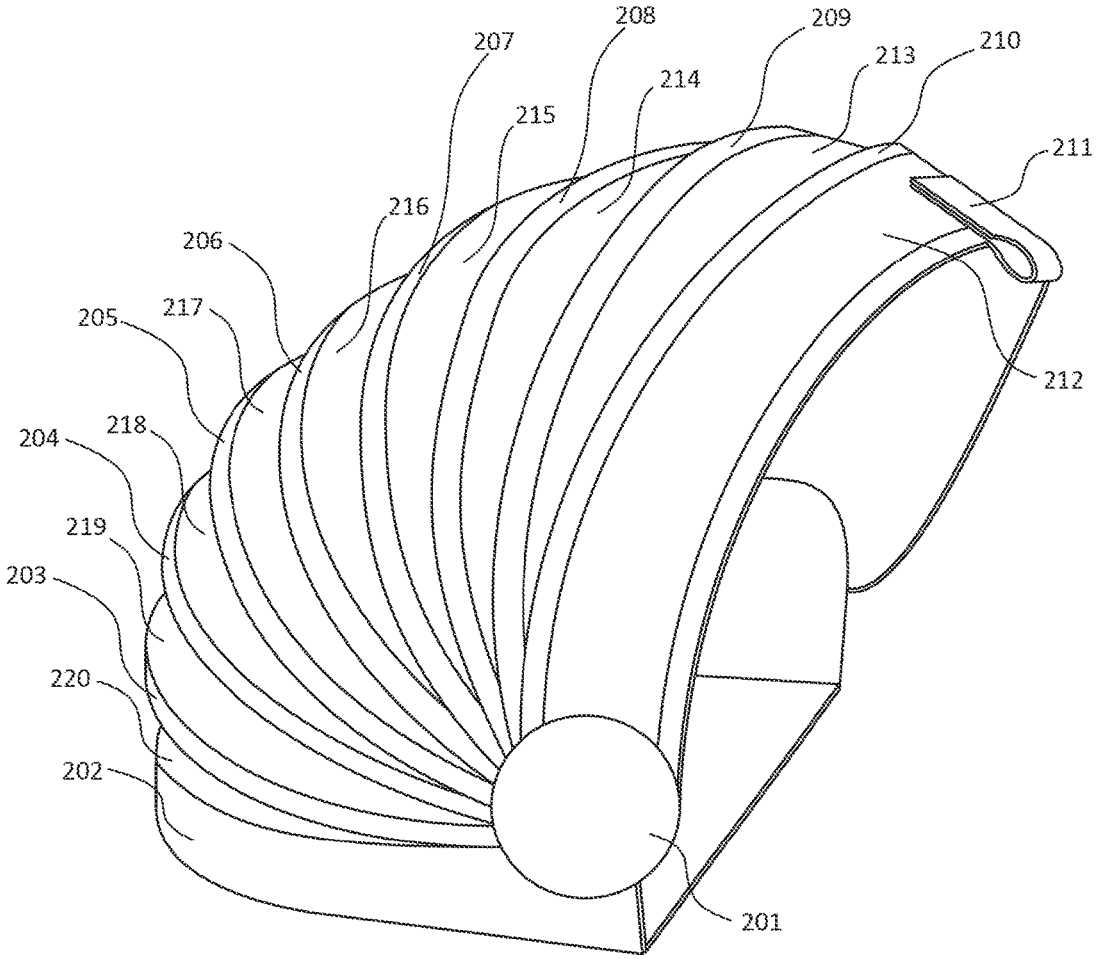
FIG. 4 is an image of an exemplary privacy shield in the third position, according to some embodiments.

As shown in FIG. 4, in an exemplary embodiment, the frame components 202, 203, 204, 205, 206, 207, 208, 209, 210 that make up the components of the privacy shield frame are attached to one another at the fulcrum in a manner that allows them to rotate about the fulcrum into the fully extended position. The frame components 202, 203, 204, 205, 206, 207, 208, 209, 210 have an edge stop which keeps them aligned while the privacy shield frame is fully extended by pulling frame pull 211 which is attached to frame 212.

In some embodiments, a dynamic desk accessory delivering on-demand privacy on an open work table can be constructed as shown where each telescoping panel 212, 213, 214, 215, 216, 217, 218, 219, 220 is made of a frame and a different interior material or it can be constructed where the each panel is made of one material on the outside of the panel and a different material on the inside of the panel or it can be constructed where each panel is made of one material. The rotary counter balance mechanism 201 can be hidden inside one of the panels or can be featured on the outside of the desk accessory. The frame pull 211 can be a loop as shown or can be any shape that allows the user a comfortable way to extend the desk accessory from the telescoped position to the extended position.

Figure 5:
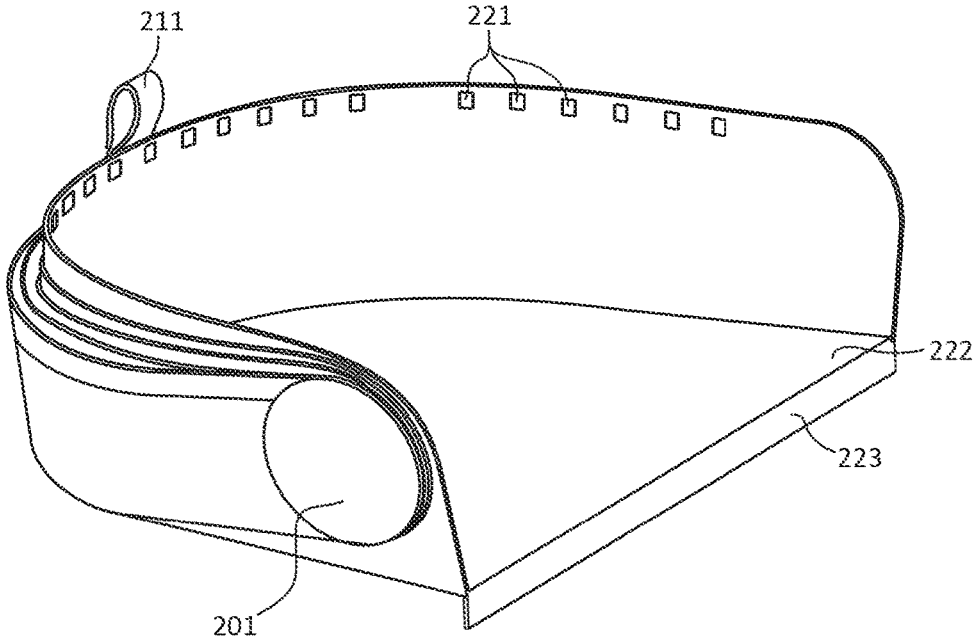
FIG. 5 is an image of an exemplary privacy shield in the first position, according to some embodiments.

As shown in FIG. 5, a dynamic desk accessory for delivering on-demand privacy on an open work table operates by means of a rotary counter weight mechanism 201. Each individual frame pivots off the counter weight mechanism 201. Each frame nests inside the adjacent frame when the invention is in the telescoped position as shown in FIG. 5. The frame pull 211 is used to pull open the invention to the fully extended position as shown in FIG. 4.

In some embodiments, the inside of the frame 212 may have lights 221 assembled on the interior. When the privacy shield is in the fully extended position, the lights 221 are automatically turned on. The floor 222 provides a desk blotter and is connected to the frame of the privacy shield in a sealed manner that insures acoustical resistance at the attachment point. The floor edge 223 is attached to the floor at a 90 degree angle and when the privacy shield is sitting on a table, the floor edge 223 is positioned over the edge of the table to keep the privacy shield sitting squarely on the table.

As shown in FIG. 4, a dynamic desk accessory delivering on-demand privacy on an open work table can be used in the telescoped position where it defines a workspace but allows for collaboration with adjacent workers. Alternately, as shown in FIG. 5, the desk accessory can be used in the extended position to provide a private work area. In the extended position, lights 221 shown in FIG. 5 provide interior lighting for the desk accessory and turn on automatically when the desk accessory is fully extended. In some embodiments, the dynamic desk accessory may also include a sound component such as a speaker, or a video component such as a video screen.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A privacy accessory comprising:

a base configured to rest on a work surface, the base defining a first side, a second side opposite the first side, a top, and a bottom, the base including:

a body portion that defines a bottom surface for resting on a work surface;

a plurality of frame members secured to the base, each frame member having a first side portion pivotably secured to the first side of the base and a second side portion pivotably secured to the second side of the base, each of the plurality of frame members telescopically received with an adjacent one of the plurality of frame members in a series of frame members that graduate from a smallest of the plurality of frame members to a largest of the plurality of frame members, the plurality of frame members being sequentially deployable to a first, expanded state by pulling on the largest of the plurality of frame members and sequentially folded to a second, collapsed state by pushing on the largest of the plurality of frame members, wherein one or more of the plurality of frame members includes at least one of a lighting component, a sound component, and a video component.

2. The privacy accessory of claim 1, wherein the plurality of frame members consists of from three and twenty frame members.

3. The privacy accessory of claim 1, and further comprising a retention portion that includes a downwardly projecting stop defining the retention edge.

4. The privacy accessory of claim 1, and further comprising a retention portion that includes a cross member, a first bracket forming a channel defining the retention edge and configured to receive a portion of the work surface, and a second bracket forming a channel defining a second retention edge and configured to receive a portion of the work surface.

5. The privacy accessory of claim 1, wherein each of the plurality of frame members includes a stop feature configured to engage an adjacent one of the plurality of frame members such that the sequence of frame members are maintained in an overlapping fashion when transitioned to the expanded and collapsed states.

6. The privacy accessory of claim 1, wherein the largest of the plurality of frame members is rotated through at least 90 degrees from the collapsed state to the expanded state.

7. The privacy accessory of claim 1, wherein the retention portion includes a clamp configured to releasably secure the retention portion to a work surface and prevent movement of the base in relation to a work surface.

8. The privacy accessory of claim 1, wherein the largest of the plurality of frame members includes at least one handle configured for use in manipulating the frame members between the expanded and collapsed states.

9. The privacy accessory of claim 1, wherein the largest of the plurality of frame members includes at least one frame pull configured for use in pivoting the frame members between the expanded and collapsed states.

10. The privacy accessory of claim 1, further comprising a retention portion that projects from the body portion, the retention portion defining a retention edge for releasably securing the base to a work surface.

11. The privacy accessory of claim 1, wherein the frame members have an arcuate shape defining a radius of curvature.

12. A work surface system comprising:

a work surface including a substantially planar member defining a front edge;

a privacy accessory, including:

a base resting on the planar member of the work surface, the base defining a first side, a second side opposite the first side, a top, and a bottom, the base including:

a body portion that is substantially arcuate in shape and defines a bottom surface resting on the planar member of the work surface;

a retention portion that projects from the body portion, the retention portion engaged with the front edge of the work surface to releasably secure the base to the work surface;

a plurality of frame members secured to the base, each frame member having an arcuate shape defining a radius of curvature and having a first side portion pivotably secured to the first side of the base and a second side portion pivotably secured to the second side of the base, each of the plurality of frame members telescopically received with an adjacent one of the plurality of frame members in a series of frame members that graduate from a smallest arc one of the plurality of frame members to a largest arc one of the plurality of frame members, the plurality of frame members being sequentially deployable to a first, expanded state by pulling on the largest arc one of the plurality of frame members and sequentially folded to a second, collapsed state by pushing on the largest radius one of the plurality of frame members.

13. The work surface system of claim 12, wherein the plurality of frame members consists of from three and twenty frame members.

14. The work surface system of claim 12, wherein the retention portion includes a downwardly projecting stop defining the retention edge.

15. The work surface system of claim 12, wherein the retention portion includes a cross member, a first bracket forming a channel releasably receiving the front edge of the work surface, and a second bracket forming a channel releasably receiving the front edge of the work surface.

16. The work surface system of claim 12, wherein each of the plurality of frame members includes a stop feature configured to engage an adjacent one of the plurality of frame members such that the sequence of frame members are maintained in an overlapping fashion when transitioned to the expanded and collapsed states.

17. The work surface system of claim 12, wherein one or more of the plurality of frame members includes at least one of a lighting component, a sound component, and a video component.

18. The work surface system of claim 12, wherein the largest arc one of the plurality of frame members is rotated through at least 90 degrees from the collapsed state to the expanded state.

19. The work surface of claim 12, wherein the retention portion includes a clamp configured to releasably secure the retention portion to a work surface and prevent movement of the retention portion in relation to a work surface.

20. The work surface of claim 12, wherein one or more of the plurality of frame members includes at least one handle configured for use in manipulating the frame members between the first expanded state and second collapsed state.

21. A method of assembling a privacy accessory, the method comprising:

pivotably securing first side portions of each of a plurality of frame members to a first side of a base that is configured to rest on a work surface, the base including a body portion that is substantially arcuate in shape and defines a bottom surface for resting on a work surface and a retention portion that projects from the body portion, the retention portion defining a retention edge for releasably securing the base to a work surface;

pivotably securing a second side portions of each of the plurality of frame members to the base, each frame member having an arcuate shape defining a radius of curvature, each of the plurality of frame members telescopically received with an adjacent one of the plurality of frame members in a series of frame members that graduate from a smallest arc one of the plurality of frame members to a largest arc one of the plurality of frame members, the plurality of frame members being sequentially deployable to a first, expanded state by pulling on the largest arc one of the plurality of frame members and sequentially folded to a second, collapsed state by pushing on the largest radius one of the plurality of frame members; and securing at least one of a lighting component, a sound component, and a video component to one or more of the plurality of frame members.

* * * * *